US007401398B2

(12) United States Patent
Matsutani et al.

(10) Patent No.: US 7,401,398 B2
(45) Date of Patent: Jul. 22, 2008

(54) METHOD OF MANUFACTURING A MAGNETIC ELEMENT FOR MULTI-PHASE

(75) Inventors: Nobuya Matsutani, Katano (JP); Hidenori Uematsu, Toyooka (JP); Tsunetsugu Imanishi, Toyooka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 227 days.

(21) Appl. No.: 11/184,895

(22) Filed: Jul. 20, 2005

(65) Prior Publication Data

US 2005/0254167 A1 Nov. 17, 2005

Related U.S. Application Data

(63) Continuation of application No. 10/488,965, filed as application No. PCT/JP03/10697 on Aug. 25, 2003, now Pat. No. 7,064,643.

(30) Foreign Application Priority Data

Aug. 26, 2002 (JP) ..... 2002-244732
Aug. 26, 2002 (JP) ..... 2002-244733

(51) Int. Cl.
*H01F 7/06* (2006.01)
*H01F 27/02* (2006.01)

(52) U.S. Cl. ..... 29/606; 29/603.1; 29/602.1; 29/605; 29/616; 336/83

(58) Field of Classification Search ..... 29/606, 29/603.1, 605, 616, 618, 619, 602.1, 650; 360/119, 123, 115; 336/212, 198, 220, 221, 336/205, 96, 83

See application file for complete search history.

(56) References Cited

U.S. PATENT DOCUMENTS

| | | | | | |
|---|---|---|---|---|---|
| 5,175,525 | A | * | 12/1992 | Smith | 336/83 |
| 5,602,381 | A | * | 2/1997 | Hoshino et al. | 235/493 |
| 5,602,382 | A | * | 2/1997 | Ulvr et al. | 235/462.02 |
| 5,755,986 | A | * | 5/1998 | Yamamoto et al. | 252/62.54 |
| 5,821,843 | A | | 10/1998 | Mamada et al. | |
| 5,949,321 | A | * | 9/1999 | Grandmont et al. | 336/232 |
| 6,175,293 | B1 | * | 1/2001 | Hasegawa et al. | 336/83 |
| 6,343,595 | B1 | * | 2/2002 | Nakabayashi et al. | 123/634 |
| 6,362,986 | B1 | | 3/2002 | Schultz et al. | 363/132 |

FOREIGN PATENT DOCUMENTS

| | | |
|---|---|---|
| JP | 54-163354 | 12/1979 |
| JP | 61-136213 | 6/1986 |

(Continued)

*Primary Examiner*—A. Dexter Tugbang
*Assistant Examiner*—Tai Van Nguyen
(74) *Attorney, Agent, or Firm*—Steptoe & Johnson LLP

(57) ABSTRACT

A magnetic element for multi-phase is composed by burying a plurality of coils in a composite magnetic material such that a negative coupling of magnetic fluxes or a positive coupling of magnetic fluxes exists between at least two coils. This structure more miniaturizes inductors, or choke coils as the multi-phase magnetic element suitably used for application of a large current to many kinds of electronic equipment. Such multi-phase magnetic element has an excellent ripple current property.

4 Claims, 7 Drawing Sheets

FOREIGN PATENT DOCUMENTS

| | | | |
|---|---|---|---|
| JP | 1-266705 | A | 10/1989 |
| JP | 3-171702 | | 7/1991 |
| JP | 6-342714 | | 12/1994 |
| JP | 8-37107 | | 2/1996 |
| JP | 8-250333 | | 9/1996 |
| JP | 8-264320 | | 10/1996 |
| JP | 8-306541 | | 11/1996 |
| JP | 9-125108 | | 5/1997 |
| JP | 11-224817 | | 8/1999 |
| JP | 2000-106312 | | 4/2000 |
| JP | 2001-23822 | | 1/2001 |
| JP | 2001-85237 | | 3/2001 |
| JP | 2001-125733 | * | 4/2001 |
| JP | 2002-43131 | | 2/2002 |
| JP | 2002-57039 | | 2/2002 |
| JP | 2002-64027 | | 2/2002 |
| JP | 2002-217416 | | 8/2002 |

* cited by examiner

PRIOR ART

METHOD OF MANUFACTURING A MAGNETIC ELEMENT FOR MULTI-PHASE

TECHNICAL FIELD

The present invention relates to a magnetic element used to such as an inductor or a choke coil of electronic equipment, and in particular to the magnetic element for multi-phase and a method of manufacturing the same.

BACKGROUND ART

Parts or devices used with miniaturized electronic equipment must be small and thin. On the other hand, as CPU's become highly integrated, they may require a current of several amperes to several tens of amperes. Accordingly, an inductor such as a choke coil used therewith must be small and have a low resistance. That is, the inductor must minimize inductance loss due to superimposed direct current. To make resistance low, a coil conductor should have a large cross sectional area, but this usually requires a large coil. Further, the inductance must have low loss at high frequencies. And since manufacturers are always seeking less expensive parts, inductors should comprise elements of simple shapes that are easy to manufacture. In particular, an inexpensive, miniaturized inductor is needed that can be used with a large current and at high frequencies. However, the high frequency and the large current of a switching frequency make it difficult to both miniaturize the parts that utilize the switching frequency and make the switching circuit highly efficient, because either a switching element increases losses or magnetism of the choke coil is saturated.

Therefore, recently, a circuit system called a multi-phase system has been adopted. For example, in a 4-phase system, four pieces of switching elements and four pieces of choke coils are used in parallel. In this circuit, for example, respective elements are driven at a switching frequency of 500 kHz, DC superimposed of 10 A, and the phase being 90° off. They apparently actuate at the driving frequency of 2 MHz and performance of DC superimposed of 40 A, thereby lowering a ripple current. Thus, the multi-phase system is a power circuit system which can realize large current and high frequency.

The above-mentioned circuit utilizes a coil and a ferrite core of EE type or EI type. The ferrite material, however, has comparatively high permeability and lower saturated flux density in comparison with metallic magnetic materials. Therefore, with a ferrite core, the inductance largely drops due to magnetic saturation, so that the property of DC superimposed tends to be low. Therefore, to improve the property of DC superimposed, the ferrite core is provided with a cavity at one portion, in a magnetic path thereof for use by decreasing the apparent permeability. However, in this method, is difficult to use with a large current because the saturated flux density is low. Having the cavity at one portion in the magnetic path of the ferrite core generates a noisy beating sound in the ferrite core.

In addition, as the core material, it employs Fe—Si—Al or Fe—Ni alloys having a larger saturated flux density than that of the ferrite. But these metallic materials have low electric resistance, so that eddy current loss is large. To compensate, these materials are made thin and laminated with insulating layers, which increases costs.

In contrast, a dust core made by forming metallic magnetic particles has a much larger saturated flux density than that of a soft magnetic ferrite, and has excellent superimposed DC current properties. Therefore, the dust core is advantageous in miniaturizing the circuitry, and no cavity is necessary, which eliminates the beating sound. A core loss of the dust core consists of a hysteresis loss and the eddy current loss, and the eddy current loss increases in proportion to square of the frequency and square of the flowing size of the eddy current. Therefore, the surfaces of the metallic magnetic particles are covered with electric insulation resin for suppressing eddy currents. On the other hand, since the dust core is generally formed at a pressure of more than several ton/cm$^2$, strain increases as a magnetic substance and permeability decreases, so that the hysteresis loss increases. To avoid this, methods to relieve strain are proposed. For example, as disclosed in Japanese Patent Unexamined Publication No. H6-342714, the same No. H8-37107, and No. H9-125108, heat treatments after forming are performed.

To further miniaturize, built-in cores are also proposed, for instance, in Japanese Patent Unexamined Publication No. S54-163354 and the same No. S61-136213. These examples of prior art use cores with ferrite dispersed in resins.

However, when a plurality of inductors are arranged to accommodate multiple multi-phases, installing spaces become large and the circuit becomes expensive. Since a plurality of cores used in the multi-phases have dispersions in inductance values, the ripple current property decreases and the efficiency of the power source also decreases.

DISCLOSURE OF THE INVENTION

In the multi-phase magnetic element of the present invention, a plurality of coils are buried in the composite magnetic material, and there are present a negative coupling of magnetic fluxes or a positive coupling of magnetic fluxes between at least two coils.

DETAILED DESCRIPTION OF PREFERRED EMBODIMENTS

Exemplary Embodiment 1

Figure 1:
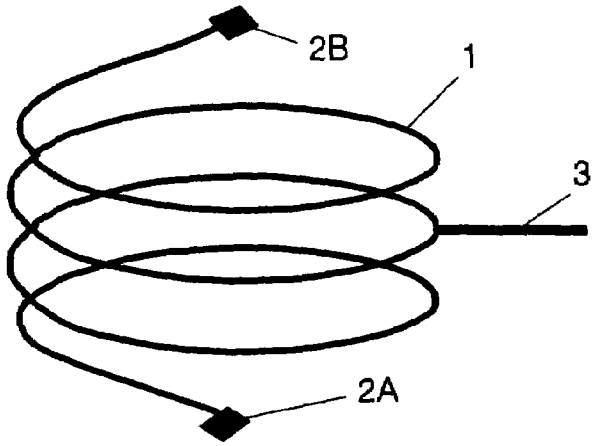
FIG. 1 is a schematic perspective view of a coil contained in a magnetic element in a first exemplary embodiment of the present invention.
Figure 2:
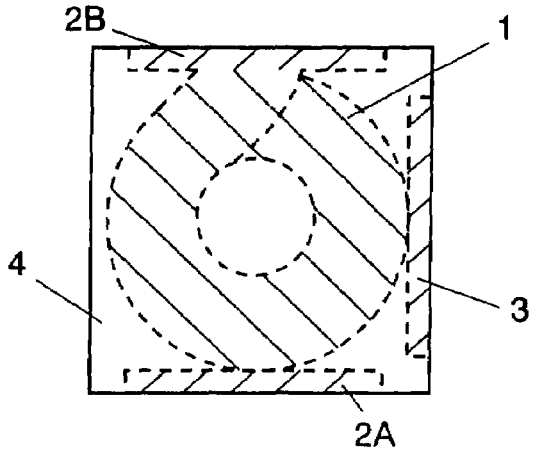
FIG. 2 is a see-through view of an upper surface of the magnetic element in the first exemplary embodiment of the present invention.
Figure 3:
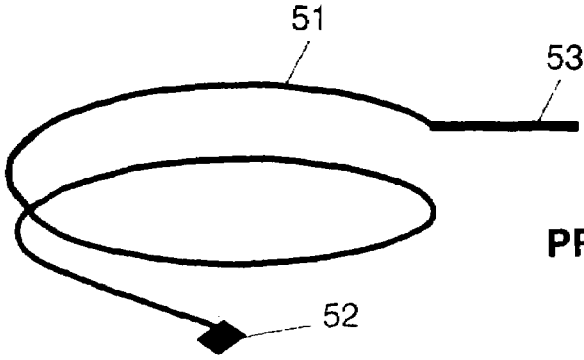
FIG. 3 is a schematic perspective view of a coil contained in a magnetic element in a comparative example in a prior art.
Figure 4:
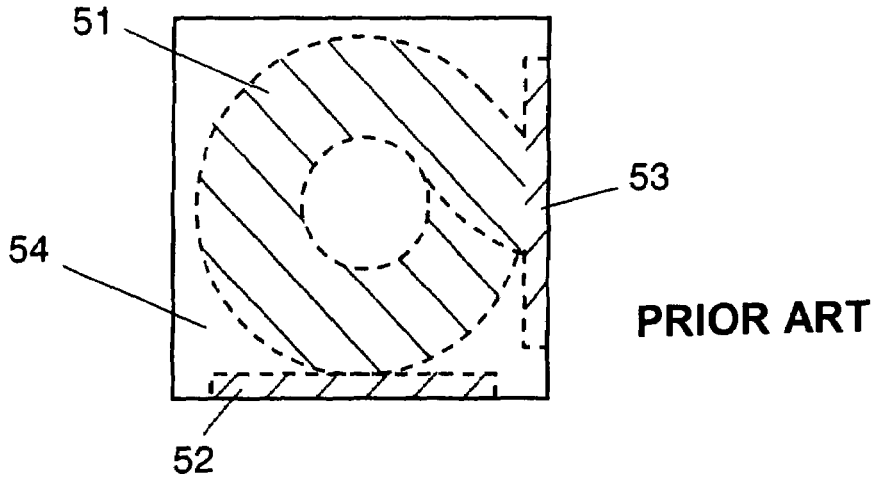
FIG. 4 is the see-through view of an upper surface in the comparative example in the prior art.

FIG. 1 is the schematic perspective view of the coil for explaining a structure of the coil contained in the multi-phase magnetic element in the first exemplary embodiment of the present invention. FIG. 2 is the see-through view of the upper surface for explaining a structure of the magnetic element in the present embodiment. The magnetic element according to the present embodiment has a coil 1 and a composite magnetic material 4. The coil 1 has input terminals 2A, 2B and an output terminal 3. FIGS. 3 and 4 are the schematic perspective view of the coil and the see-through view of the upper surface of the magnetic element for explaining a shape of the coil and a structure of the magnetic element in the comparative examples of the prior art. The prior magnetic element has a coil 51 and a composite magnetic material 54. The coil 51 has an input terminal 52 and an output terminal 53.

Figure 5:
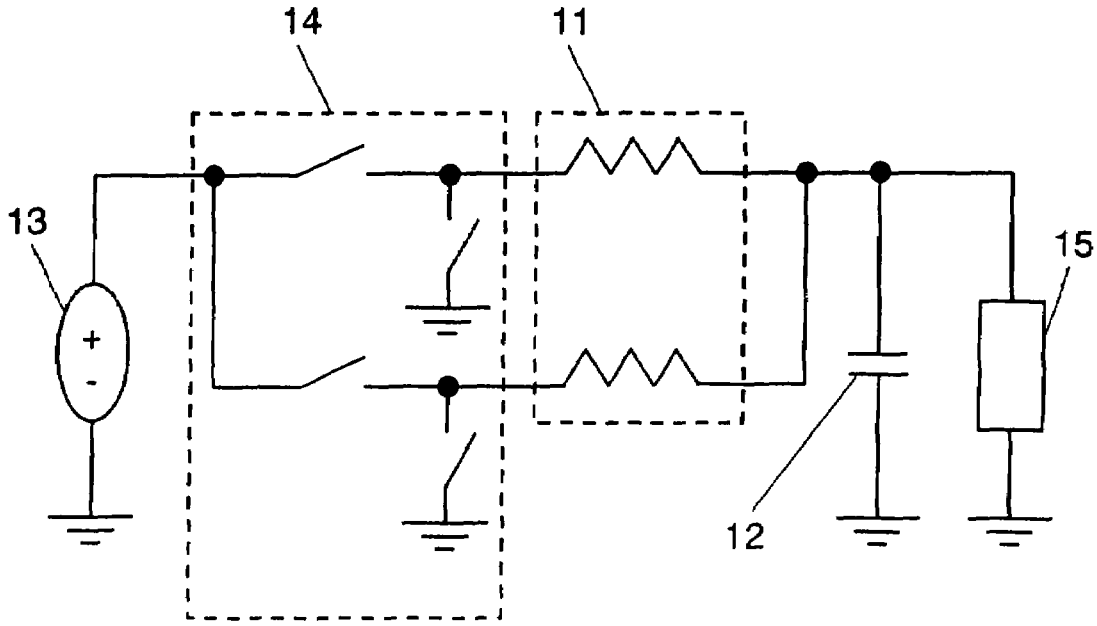
FIG. 5 is a power circuit of a multi-phase system.

The following description will explain a case of using the magnetic element according to the present embodiment as a choke coil in a circuit of the multi-phase system. FIG. 5 shows a power circuit using the multi-phase system, and this is a 2-phase system. This circuit (DC/DC converter) converts DC voltage of a battery 13 into an appointed DC voltage. A choke coil 11 and a capacitor 12 form an integration circuit. This circuit is connected with a switching element 14, and the power circuit is connected at an output with a load 15. In FIG. 1, the coil of 3.5 turns has the output terminal 3 just at 1.75 turns being the coil center. The two input terminals 2A, 2B of the coil 1 are respectively connected to the switching element 14 of FIG. 5. In this arrangement, the coil 1 serves by itself as two choke coils in common having the output terminal 3. An electric current flows from the respective input terminals 2A, 2B to the output terminal 3. Since DC magnetic fluxes passing through both coil ends are opposed to each other, a magnetic field at the coil is as a whole weakened. In the following description, an arrangement where the DC magnetic fluxes passing through the coil center weaken each other will be called a negative coupling of magnetic fluxes. Conversely, an arrangement where the DC magnetic fluxes passing through the coil center strengthen each other will be called a positive coupling of magnetic fluxes. The positive and negative couplings of the magnetic fluxes vary on the arrangement of the coils, the turning direction of the coils, or the flowing direction of current.

The following description will state the specific structure of the magnetic element and properties thereof in the present embodiment compared to the prior art. A first reference will be made to a method of producing the magnetic element in this embodiment. As a raw material of the composite magnetic material 4, soft magnetic alloy particles of iron (Fe) and nickel (Ni) of average diameter being 13 .mu.m made by a water atomizer method are prepared. The alloying compositions are 50 weight % respectively in Fe and Ni. Then, as an insulation binding agent, a silicone resin is added by 0.033 weight ratio to the above alloying particles, sufficiently mixed, and passed through a mesh to turn out regular particles. Next, a punched copper plate is used for preparing the coil 1 of 4.2 mm inner diameter and 3.5 turns having the output terminal 3 at its intermediate portion. At this time, the thickness of the coil 1 is changed to adjust to have direct current resistance values (Rdc) of Table 1. Subsequently, the regular particles and the coil 1 are charged in a metal mold (not shown) and pressed into a shape at 3 ton/cm.sup.2. Further, the product is taken out from the mold, followed by performing a heat treatment at 150.degree. C. for 1 hour and hardening. Thus, burying the coil in the composite magnetic material of the soft magnetic alloying particles and the insulation binding agent, insulation and withstand voltage are in particular maintained between the core and the coil.

Thus, as shown in FIG. 2, the 2-phase magnetic element of 10 mm H.times.10 mm L×4 mm T is provided, which stores two inductor coils, and has the input terminals 2A, 2B and the output terminal 3. For comparison, by use of the copper plate punched similarly as mentioned above, the coil of the 4.2 mm inner diameter and the 1.75 turns is prepared as shown in FIG. 3. This coil is so adjusted to be Rdc of Table 1 by varying the coil thickness. Next, in the same manner as the present embodiment, the magnetic elements shown in FIG. 4 of 10 mm H×10 mm L×3 mm T are prepared two in total, each storing one coil therein. Namely, a composite magnetic material 54 has the same structure as that of the composite magnetic material 4. As to the inductance values of these magnetic elements, any of the coils have inductance of 0.25 to 0.26 .μH in DC value of I=OA.

The evaluated results of these magnetic elements are shown in Table 1.

TABLE 1

| Sample No. | DC resistant value Rdc (Ω) | Coupling | Maximum current value (A) | Efficiency (%) |
|---|---|---|---|---|
| 1 | 0.002 | Negative | 40 | 92 |
| 2 | 0.01 | Negative | 40 | 90 |
| 3 | 0.05 | Negative | 42 | 86 |
| 4 | 0.06 | Negative | 43 | 83 |
| 5 | 0.01 | Naught | 18 | 88 |

Table 1 shows the power supply efficiency when driving in the 2-phase circuit system, using the above mentioned magnetic elements, at the frequency of 400 kHz per one inductor coil and 20 A of DC superposed. The samples Nos. 1 to 4 are the structures of the present embodiment, and No. 5 is the structure of the comparative example.

The ripple current rate is a ratio of the ripple current to the current of DC superimposed. A choke coil is more effective as its ripple current rate approaches zero, which means it has a strong smoothing effect. In the samples Nos. 1 to 4, the ripple current rates fall in the range between 0.8 and 1.5%. The maximum current value signifies the DC values when the inductance value L at the current value of I=OA decreases by 20%.

As shown in Table 1, burying the two inductors and utilizing a negative coupling of the magnetic fluxes results in superior results with a DC current superimposed than when two pieces of choke coils without the coupling are used, as shown in FIG. 4. In addition, each of the inductors realizes the efficiency of at least 85% in case of Rdc≦0.05Ω, and the efficiency of at least 90% in case of Rdc≦0.010Ω. By suppressing Rdc as described above, a miniaturized multi-phase magnetic element with less loss of the coil part (Copper loss) is obtained.

There is a conventional chip array that stores a plurality of coils, as disclosed in, for example, Japanese Patent Unexamined Publication Nos. H8-264320 and 2001-85237. These disclosed chip arrays are primarily for removing noises at signal level, and the large superimposed DC current (more than 1 A, preferably more than 5 A) of the present embodiment is substantially different from the choke coils. Other conventional chip arrays are also disclosed in Japanese Patent Unexamined Publication Nos. H8-306541 and 2001-23822, in which sintered ferrites are wound with a plurality of coils, and a heat treatment for burying the coils in the sintered ferrite is carried out at higher than 600° C. Even if these techniques were applied to a circuit using a large current, the value of the inductor with DC superimposed would be too low to use, since the sintered ferrite has a low saturated magnetic flux density. On the other hand, in the present embodiment, magnetic particles of the metallic particles are used as the composite magnetic material 4. Since the magnetic element according to the embodiment is used as the multi-phase choke coil of the power source of a large current, the driving frequency per one element is at least 50 kHz and at most 10 MHz, preferably at least 100 kHz and at most 5 MHz. Thus, the magnetic element of the embodiment has a very different driving frequency than conventional chip arrays.

Further, as disclosed in Japanese Patent Unexamined Publication Nos. H8-250333 and H11-224817, the conventional chip arrays exclude most of the crosstalk between neighboring coils. In contrast, the present embodiment adopts positive and negative coupling of the magnetic fluxes between at least two neighboring inductances. Also, the magnetic element of the present embodiment is very different from the conventional chip array. That is, in the present embodiment, the larger the coupling coefficient k (indicating the coupling between the inductors), the better the coupling. In other words, the nearer k is to 1, the better the coupling. And even if the coupling coefficient is at least 0.05, there is some effect, but the coefficient will preferably be at least 0.15.

If the DC input directions or the coil winding direction are designed for plural inductors, and if the negative magnetic fluxes are coupled to the neighboring inductors, the DC magnetic fields which occur at the centers of the respective inductors negate one another. Therefore, the magnetic substance is not easily saturated even with a large current. The structure of the present embodiment can prevent the magnetic flux from saturation, and also has better characteristics with a DC superimposed than when two inductors with the same number of turns are used. The choke coil of the present embodiment has a low DC resistance value, a small footprint, and good multi-phase characteristics.

In embedded inductors, the negative coupling of the magnetic fluxes is desirable for lowering the ripple current with only DC magnetic fields between at least two neighboring inductors, while AC magnetic fields are not coupled. It is therefore also acceptable to introduce a short ring which couples with the DC magnetic fields between the neighboring inductors, but can cancel the AC magnetic fields.

By the structure in FIGS. 1 and 2, two negatively coupled inductors can be easily realized from one coil.

If using the terminals 2A, 2B as an input terminal and an output terminal while leaving the terminal 3 open, it is possible to treat the structure as one inductor having a large inductance value. FIG. 1 is one example, and the structure is not limited thereto.

Generally, since dispersions (inductance value) between cores of the magnetic element are nearly .+–0.20%, when a plurality of cores are used for the multi-phase, the ripple current value generally increases. In the present embodiment, a plurality of inductances is buried in one magnetic substance. Such a structure can keep dispersions of the inductance values in the magnetic substance small, and consequently, the ripple current value is decreased.

The present embodiment, explains the 2-phase magnetic element, but the present invention is not limited to the 2-phase, and similar effects are also available in a multi-phase magnetic element. For example, by providing input terminals at both ends of one coil and at the center of its turns, and providing output terminals at the intermediate portion of the input terminals, a 4-phase magnetic element is available.

Exemplary Embodiment 2

Figure 6:
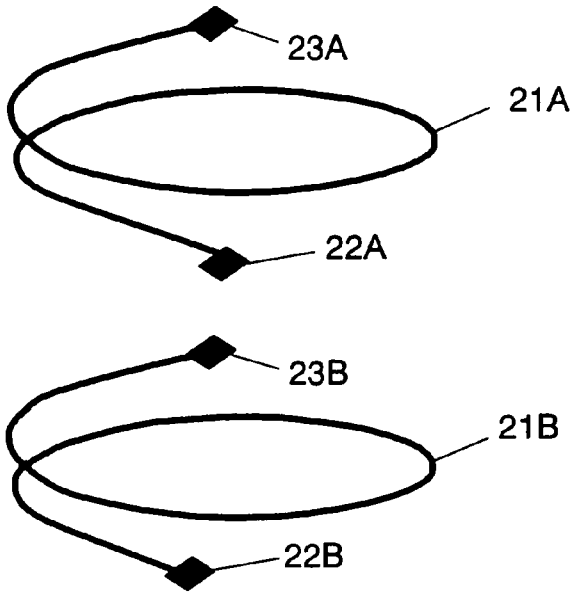
FIG. 6 is a schematic perspective view of upper and lower coils of a magnetic element in a second exemplary embodiment of the present invention.
Figure 7A:
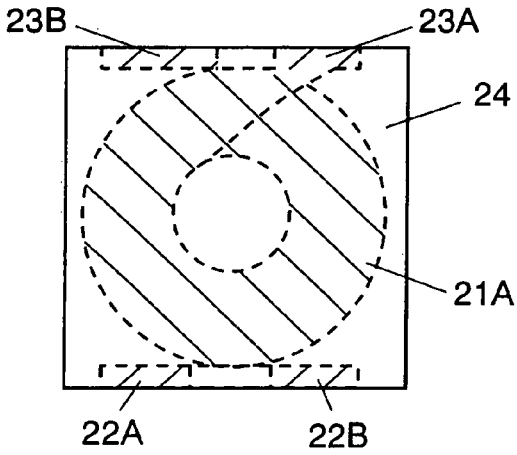
FIG. 7A is the see-through view of an upper surface of the magnetic element in the second exemplary embodiment of the present invention.
Figure 7B:
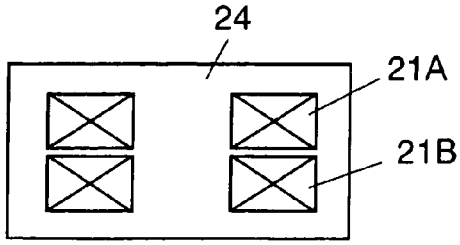
FIG. 7B is a cross sectional view of the magnetic element of FIG. 7A.
Figure 8:
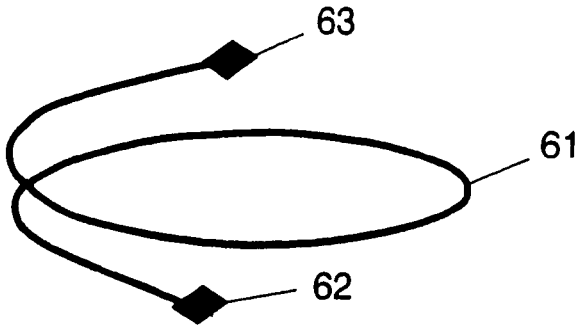
FIG. 8 PRIOR ART
FIG. 8 is a schematic perspective view of a coil contained in a magnetic element in a comparative example in a prior art.
Figure 9A:
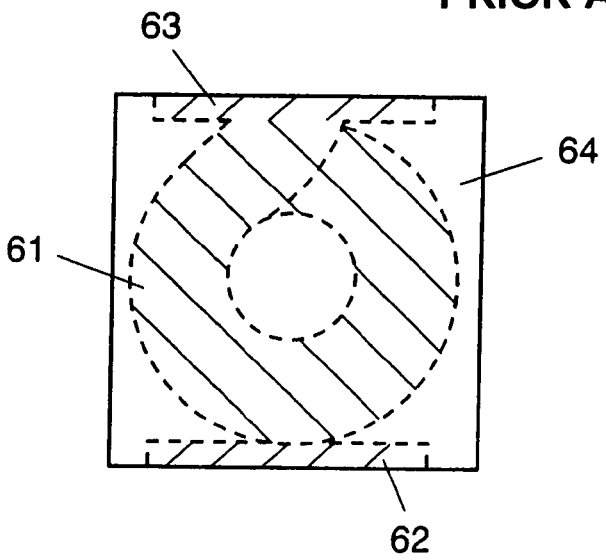
FIG. 9A PRIOR ART
FIG. 9A is a see-through view of an upper surface of the magnetic element in the comparative example according to the prior art.
Figure 9B:
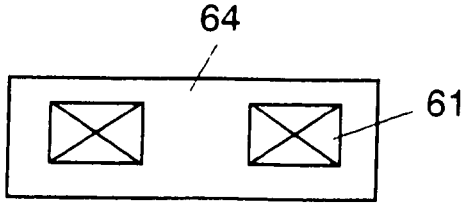
FIG. 9B PRIOR ART
FIG. 9B is a cross sectional view of the magnetic element of FIG. 9A.

FIG. 6 shows schematic perspective views of the coils for explaining the coil structure contained in the multi-phase magnetic element in the second exemplary embodiment of the present invention. FIGS. 7A, 7B are respectively the see-through view of the upper surface of the magnetic element and the cross sectional view of the same for explaining the magnetic element in the present embodiment. The magnetic element according to the present embodiment has an upper coil 21A, a lower coil 21B and a composite magnetic material 24. The upper coil 21A and the lower coil 21B have respectively input terminals 22A, 22B and output terminals 23A, 23B. FIG. 8 is the schematic perspective view of the coil for explaining a structure of the coil contained in the multi-phase magnetic element in the comparative examples of the prior art. FIGS. 9A, 9B are respectively the see-through view of the upper surface of the magnetic element and the cross sectional view of the same for explaining the structure of the magnetic element in the prior art. The prior magnetic element has a coil 61 and a composite magnetic material 64, and the coil 61 has an input terminal 62 and an output terminal 63.

The following description will explain the use of the magnetic element according to the present embodiment as a choke coil within a circuit of the multi-phase system shown in FIG. 5. In FIG. 6, the magnetic element according to the present embodiment is structured by vertically laminating the coils of 1.5 turns. In short, the input terminals 22A, 22B provided in the coils 21A, 21B are connected to the switching element 14 in FIG. 5. The electric current flows from the input terminal 22A to the output terminal 23A, and from the input terminal 22B to the output terminal 23B. Since DC magnetic fluxes passing through both coil ends are oriented in the same direction, a magnetic field of the coil is strengthened. That is, the DC magnetic fluxes passing through the centers of the neighboring coils are arranged to strengthen each other, resulting in positive coupling of the magnetic fluxes.

The following description will state the specific structure of the magnetic element and properties thereof in the present embodiment compared to the prior art.

A reference will be made to a method of producing the magnetic element in this embodiment. As a raw material of the composite magnetic material 24, soft magnetic alloy particles of iron (Fe) and nickel (Ni) of average diameter being 17 .mu.m made by a water atomizer method are prepared. The alloying compositions are Fe of 60 weight % and Ni of 40 weight %. Then, as an insulation binding agent, a silicone resin is added by 0.032 weight ratio to the above alloying particles, sufficiently mixed, and passed through a mesh to turn out regular particles. Next, the punched copper plate is used for preparing the coils 21A, 21B of 3.7 mm inner diameter and 1.5 turns. At this time, the thicknesses of the coils 21A, 21B are adjusted to have direct current resistance values (Rdc) of Table 2. Subsequently, the regular particles and the coil 21A, 21B laminated vertically and in the same turning direction are charged in the metal mold (not shown) and pressed into a shape at 4 ton/cm.sup.2. Next, the product is taken out from the mold, and a heat treatment is performed at 150° C. for 1 hour and the product is hardened.

The 2-phase magnetic element, as shown in FIG. 7, is made by setting up the coils 21A, 21B vertically and has the following dimensions: 10 mm H×10 mm L×4 mm T. For comparison, by use of the copper plate punched similarly as mentioned above, the coil of the 3.7 mm inner diameter and the 1.5 turns is prepared as shown in FIG. 8. This coil is so adjusted to be Rdc of Table 2 by varying the coil thickness. Next, in the same manner as the present embodiment, the magnetic elements of 10 mm H×10 mm L×3 mm T shown in FIGS. 9A, 9B are prepared two in total, storing one coil therein. Namely, the composite magnetic material 64 has the same structure as that of the composite magnetic material 24. As to the inductance values of these magnetic elements, the coils have inductances of 0.22 to 0.23 μH in DC value, where I=OA.

The evaluated results of these magnetic elements are shown in Table 2. Table 2 shows the ripple current rates when driving the 2-phase circuit system, using the above-mentioned magnetic elements, at the frequency of 450 kHz per one inductor coil and 15A of DC superimposed. The ripple current rate is the ratio of the ripple current to the current of DC superimposed. The choke coil characteristics improve as the ripple current rate approaches zero, which results in a significant smoothing effect. The maximum current value signifies the DC values when the inductance value L at the current value of I=OA decreases by 20%. In all the samples, the maximum current value ranges from 16 to 34 A. The samples 6 to 9 are the structures according to the present embodiment, while the sample 10 is the structure of the comparative example.

TABLE 2

| Sample No. | DC resistant value Rdc (Ω) | Coupling | Ripple current (%) | Efficiency (%) |
|---|---|---|---|---|
| 6 | 0.002 | Positive | 0.8 | 92 |
| 7 | 0.01 | Positive | 0.8 | 90 |
| 8 | 0.05 | Positive | 0.7 | 87 |
| 9 | 0.06 | Positive | 0.5 | 83 |
| 10 | 0.01 | Naught | 3.0 | 90 |

As shown in Table 2, the structures of the samples 6 to 9 with the two inductors buried with existence of the positive coupling of the magnetic fluxes show better ripple current properties than the sample 10 using two choke coil pieces without the coupling shown in FIG. 9.

In addition, each of the inductors realizes the efficiency of at least 85% in case of Rdc≦0.05Ω, and the efficiency of at least 90% in case of Rdc≦0.01Ω.

Further, the larger the coupling coefficient k, which reflects the coupling between the inductors, or the nearer to k is to 1, the better the coupling. Results are noticeable even if the coupling coefficient is as low as 0.05, but the coefficient will preferably be at least 0.15.

When designing the current input directions for the plural inductors or the coil winding directions, making a positive coupling of the magnetic fluxes of the neighboring coils, increases values and improves ripple current properties. Namely, the choke coil property varies depending on the positive or the negative coupling of the magnetic fluxes of the neighboring coils. The negative coupling of the magnetic fluxes is better when DC current is superimposed, and positive coupling of the magnetic fluxes results in a better ripple current property. Thus, either the negative coupling or the positive coupling can be used, depending on the circuit or the purpose of the electronic equipment.

Generally, since dispersions (inductance value) between the cores of the magnetic element are nearly .+−0.20%, when a plurality of cores is used for the multi-phase, the ripple current value generally increases. In the present embodiment, a plurality of inductances are buried in one magnetic substance. Also, the magnetic fluxes of the neighboring coils are structured to provide positive coupling. Such a structure can keep dispersions of the inductance values in the magnetic substance smaller than in the first embodiment, and the ripple current value is decreased.

The present embodiment describes a 2-phase magnetic element, but is not limited to the 2-phase, and similar effects are also available in the multi-phase magnetic element. For example, if three coils are laminated and formed in the same turning direction and buried in one composite magnetic material, a 3-phase magnetic element is available.

Exemplary Embodiment 3

Figure 10:
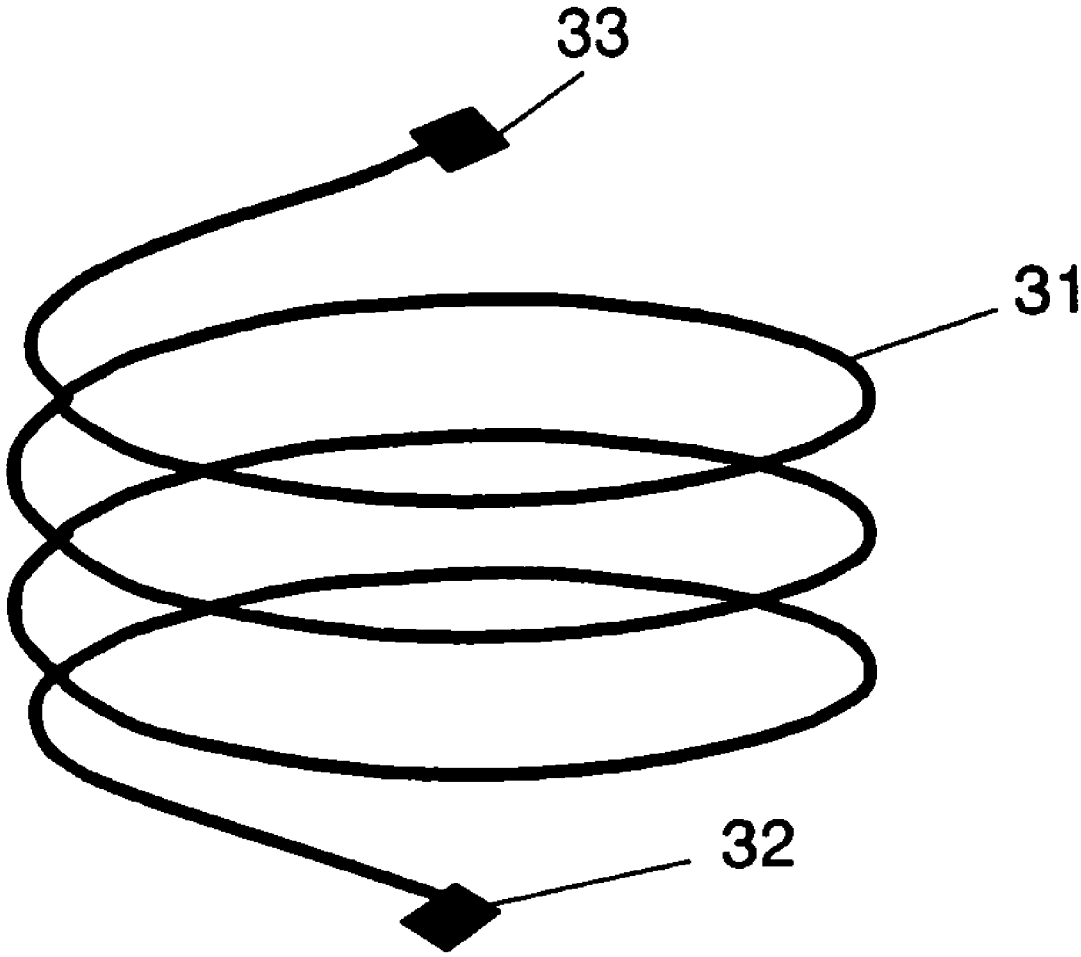
FIG. 10 is a schematic perspective view of a coil contained in the magnetic element in a third exemplary embodiment of the present invention.
Figure 11:
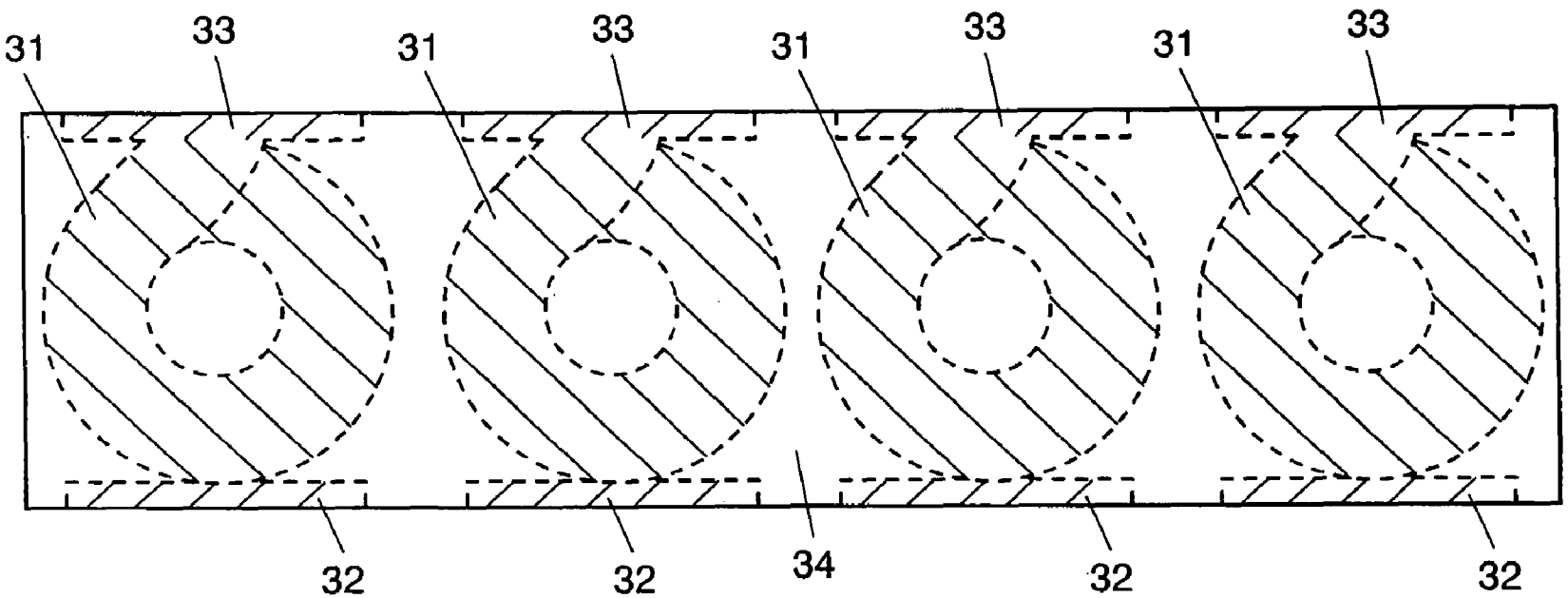
FIG. 11 is a see-through view of an upper surface of the magnetic element in the third exemplary embodiment of the present invention.

FIG. 11 is the see-through view of the upper surface of the magnetic element in the third exemplary embodiment of the present invention. FIG. 10 is the schematic perspective view of each coil contained in the magnetic element in FIG. 11. The coil 31 has an input terminal 32 and an output terminal 33. In FIG. 11, since a plurality of neighboring coils 31 has the same turning direction, negative coupling occurs in the coil centers of the respective neighboring coils buried in a composite magnetic material 34. Such a structure brings about the miniaturized multi-phase magnetic element having excellent superimposed DC characteristics.

The following description will state the specific structure of the magnetic element and properties thereof. The present embodiment employs, as a raw material of the composite magnetic material 34, ingot-pulverized particles composed of the metallic magnetic particles having compositions shown in Table 3. Then, as an insulation binding agent, a bisphenol A type resin is added by 0.03 weight ratio to the above pulverized particles, sufficiently mixed, and passed through a mesh to turn out regular particles. Next, the punched copper plate is used for preparing the coil 31 of 2.2 mm inner diameter and 3.5 turns. Then, the thickness of the coil 31 is changed to adjust direct current resistance values (Rdc) to be 0.01Ω. The regular particles and the four coils 31 are charged in the metal mold (not shown) in the same turning direction, and pressed into a shape at 3 to 5 ton/cm$^2$. Herein, each of inductors is made 0.12 to 0.17 μH at the current value I=OA in a final product. Next, the product is taken out from the mold, heat treatment is performed at 120° C. for 1 hour, and the product is hardened.

Thus, as shown in FIG. 11, the 4-phase magnetic element is made, having the following dimensions: 6.5 mm H×26 mm L×4 mm t. This magnetic element stores four inductor coils therein. In the sample No. 25, since the magnetic particle diameter is 0.8 μm, the inductance value is only 0.1 μH at the current value I=OA.

The evaluated results of these magnetic elements are shown in Table 3. In Table 3, the column of the magnetic particle composition shows the respective elements and their weight %, and the weight % of Fe is found by subtracting the sum of weight % of the other element(s) from 100%.

Table 3 shows the power supply efficiency when driving the 4-phase circuit system, using the above mentioned magnetic element, at the driving frequency of 1 MHz per one inductor coil and 15A of DC superimposed. The maximum current value signifies the DC values when the inductance value L at the current value of I=OA decreases by 20%.

TABLE 3

| Sample No. | Composition of magnetic particle | Particle size (μm) | Maximum current value (A) | Efficiency (%) |
|---|---|---|---|---|
| 11 | Fe | 10 | 30 | 90 |
| 12 | Fe—0.5Si | 10 | 30 | 91 |
| 13 | Fe—3.5Si | 10 | 26 | 91 |
| 14 | Fe—6Si | 10 | 24 | 93 |
| 15 | Fe—Fe9.5Si | 10 | 20 | 90 |
| 16 | Fe—10Si | 10 | 14 | 90 |
| 17 | Fe—50Si | 10 | 26 | 91 |
| 18 | Fe—80Si | 10 | 20 | 93 |
| 19 | Fe—3Al | 10 | 26 | 91 |
| 20 | Fe—4Al—5Si | 10 | 18 | 90 |
| 21 | Fe—5Al—10Si | 10 | 13 | 91 |
| 22 | Fe—45Ni—25Co | 10 | 19 | 92 |
| 23 | Fe—2V—49Co | 10 | 31 | 93 |
| 24 | MnZn ferrite | 10 | 8 | 87 |
| 25 | Fe—4.5Si—4.5Cr | 0.8 | 27 | 84 |
| 26 | Fe—4.5Si—4.5Cr | 1 | 25 | 93 |
| 27 | Fe—4.5Si—4.5Cr | 10 | 24 | 92 |
| 28 | Fe—4.5Si—4.5Cr | 50 | 22 | 90 |
| 29 | Fe—4.5Si—4.5Cr | 100 | 20 | 85 |
| 30 | Fe—4.5Si—4.5Cr | 110 | 18 | 83 |

As shown in Table 3, when the composition of the magnetic particles made up of a soft magnetic alloy containing Fe, Ni and Co is at least 90 weight % in total, the maximum current value shows at least 15 A. If the alloy contains more than 90 weight % Fe, Ni and Co, a highly saturated magnetic flux density and a high permeability can be realized.

As shown in Table 3, when the magnetic particle diameter is at most 100 μm, the efficiency is at least 85%; and further, when it is most 50 μm, the efficiency is at least 90%. This is because making the average diameter of the soft magnetic particles at most 100 μm is effective for decreasing an eddy current. It is more preferable that an average diameter of the soft magnetic particles is at most 50 μm. In addition, if the average diameter is less than 1 μm, a forming density is small, and the inductance value undesirably goes down.

A method of producing the magnetic element according to the present embodiment will now be explained. First, a non-hardened thermosetting resin is mixed with the soft magnetic alloy particles. Next, this mixture is made granular. The metal magnetic particles can be mixed with the resin component as it is and processed in a subsequent forming process. But once the magnetic particles pass through a mesh to be regular particles, the fluidity of the particle heightens, and the metal magnetic particles are ready for handling.

Next, the granules are put into the mold together with the at least two coils and press-formed. The windings of neighboring coils are in the same winding direction. Meanwhile, if the pressure for heightening the filling factor is increased, the saturated magnetic flux density, and the permeability, become high, but the insulation resistance and the withstand voltage decrease. Further, a residual stress depending on the magnetic substance becomes large and the magnetic loss increases. On the other hand, if the filling factor is too low, the saturated magnetic flux density and the permeability are low, decreasing the inductance value or degrading DC superimposed characteristics. In addition, taking a life of the mold into consideration, the pressure at press-forming is 1 to 5 ton/cm$^2$, more desirably 2 to 4 ton/cm$^2$.

Next, the formed body is heated to harden the thermosetting resin. Here, if the temperature is increased to the resin hardening temperature while press-forming the formed body in the metal mold, an electric resistivity is easily increased. But in this method, productivity is low, and therefore, the press-forming may be carried out at a room temperature, followed by heat-hardening. In such a manner, the multi-phase magnetic element is provided.

For supplying to a CPU, it is preferable that the input terminal and the output terminal of the multi-phase magnetic element be arranged at an angle of at least 80°.

In regard to the present embodiment, a 4-phase magnetic element is described, but the invention is not limited to the 4-phase. For example, the 2-phase magnetic element with two coils brings about the similar effects to the multi-phase magnetic element.

Exemplary Embodiment 4

Figure 12A:
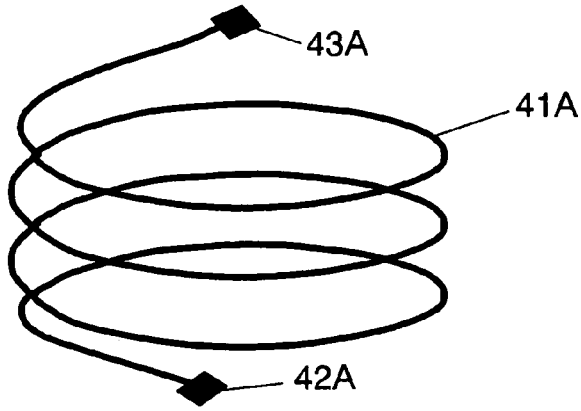
FIG. 12A is a schematic perspective view of a coil contained in a magnetic element in a fourth exemplary embodiment of the present invention.
Figure 12B:
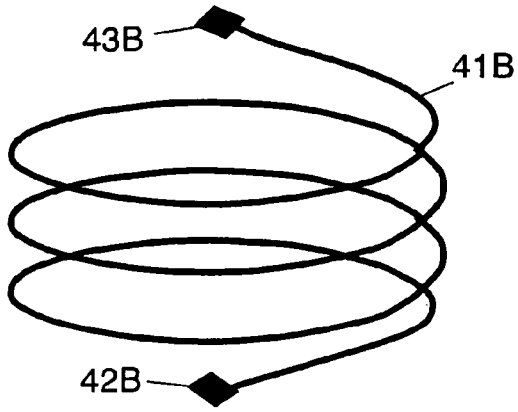
FIG. 12B is a schematic perspective view of a coil neighboring the coil of FIG. 12A.
Figure 13:
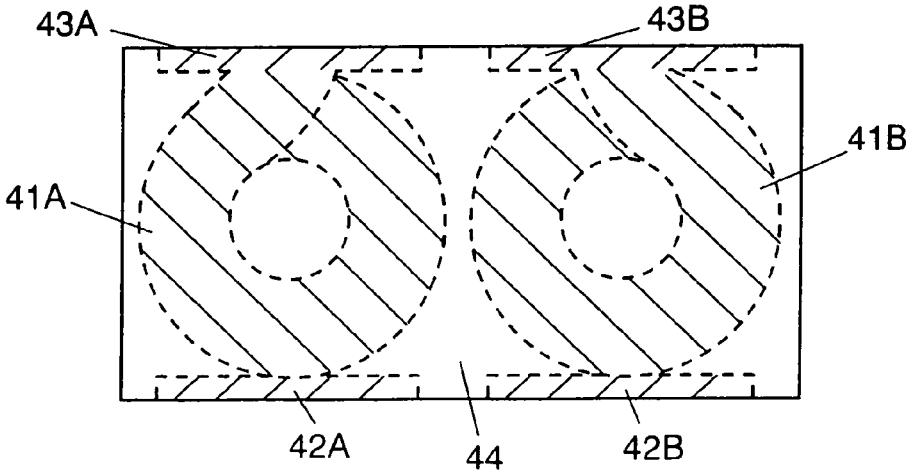
FIG. 13 is a see-through view of an upper surface of the magnetic element in the fourth exemplary embodiment of the present invention.

FIG. 13 is the see-through view of the upper surface of the magnetic element in the fourth embodiment of the present invention. FIG. 12 shows the schematic perspective views of the coils contained in the magnetic element in FIG. 13. Coils 41A, 41B have input terminals 42A, 42B and output terminals 43A, 43B, respectively. In FIG. 13, the two neighboring coils 41A, 41B have the same number of turns, but the turning directions are reversed. Accordingly, the magnetic fluxes create a positive coupling through the centers of the neighboring coils. The coils 41A, 41B are buried in the composite magnetic material 44. Such a structure realizes the miniaturized multi-phase magnetic element with excellent ripple current properties.

The following description will state the specific structure of the magnetic element and properties thereof. The present embodiment employs, as a raw material of the composite magnetic material 44, Fe—Si soft magnetic alloying particles, with an average diameter of 20 μm, made by a gas atomizer method. The weight ratio of Fe and Si is 0.965:0.035. Then, as the insulation binding agent, the silicone resin is added by 0.02 to 0.04 weight ratio to the above alloy particles, sufficiently mixed, and passed through a mesh to turn out regular particles.

Next, the punched copper plate is used for preparing the coils 41A, 41B of 3.3 mm inner diameter and 3.5 turns. At this time, the thicknesses of the coils 41A, 41B are changed to adjust the direct current resistance values (Rdc) to be 0.02Ω. Subsequently, the regular particles and the coils 41A, 41B are charged in the metal mold (not shown) in the reverse turning directions for pressure-forming. Then, the pressure is adjusted at the range between 0.5 and 7 ton/cm$^2$ in order to have the filling factors shown in Table 4. Further, the formed product is taken out from the mold, followed by performing the heat treatment at 150° C. for 1 hour and hardening.

Thus, as shown in FIG. 13, the 2-phase magnetic element of 10 mm H×20 mm L×4 mm T is provided, which stores two inductors therein.

As shown in FIG. 13, the turning directions of the neighboring coils 41A, 41B are reverse, showing the positive coupling of the magnetic fluxes. The inductance values at this time, are 0.25 to 0.28 μH of the inductance coils of the samples Nos. 32 to 36 at the current values of I=OA, and the inductance value of the sample No. 31 is 0.22 μH.

Further, a sample may be made for measuring insulation resistance without burying any coil by making a disk-like sample of 10 mm diameter and 1 mm thickness at the same time as the above-mentioned regular soft magnetic alloy particles.

Table 4 shows the insulation resistant values, the withstand voltages, and the maximum current values when driving the 2-phase circuit system, using the above mentioned magnetic element, at the frequency of 800 kHz per one inductor coil and 30 A of DC superimposed. The insulation resistance is measured where both ends of the sample for measuring insulation resistance are kept with alligator clips and electric resistance is measured at 100 V. The insulation resistant rates in the table standardize the thus measured insulation resistance with the length and the cross sectional area of the sample. The electric resistance is measured by 100 V, by increasing the voltage to 500 V, and obtaining the voltage as the resistance rapidly drops. The withstand voltage is the voltage immediately before dropping. The maximum current value signifies the current value of DC superimposed when the inductance value L is down by 20%, where the current value is I=OA.

The evaluated results of these magnetic elements are shown in Table 4.

TABLE 4

| Sample No. | Filling factor (Volume %) | Insulation resistance (Ω · cm) | Withstand voltage (V) | Maximum current value (A) |
|---|---|---|---|---|
| 31 | 63 | $10^{12}$ | >500 | 27 |
| 32 | 65 | $10^{11}$ | >500 | 35 |
| 33 | 70 | $10^{10}$ | >500 | 42 |
| 34 | 85 | $10^{7}$ | 400 | 45 |
| 35 | 90 | $10^{5}$ | 200 | 48 |
| 36 | 92 | $10^{3}$ | <100 | 50 |

As shown in Table 4, when the filling factor of the soft magnetic alloying particles is at most 90 volume %, the embodiment has excellent DC superimposed values and insulation resistance values. If the filling factor is low, less than 65 volume %, the saturated magnetic flux density and the permeability are low, and neither a sufficient inductance value nor a DC superimposed value is available. If the particles are charged so as not to be plastic-deformed at all, generally an upper limit of filling factor is 60 to 65 volume %, and the saturated magnetic flux density and permeability are too low. Accordingly, a filling degree relative to the plastic deformation is necessary, that is, the filling factor of at least 65 volume % is preferable, and more preferably it is at least 70 volume %.

On the other hand, if the occupancy of the alloy particle exceeds 90 volume %, a core insulation goes down, so that the insulation to the coil cannot be kept. Thus, the upper limit of the filling factor is set to be a range where the insulation resistance does not go down, but taking internal storage of the coil into consideration, the insulation resistant rate must be at least around $10^5$ Ωcm, and the filling factor of at most 90% is preferable, and more preferably at most 85%.

All the embodiments explained above employ the magnetic particles made of the metallic particles as the composite magnetic material. Using substances dispersed with the ferrite particles instead of the metallic particles, the saturated magnetic flux density is low and the property of DC superimposed is inferior because of ferrite's limited filling factor.

Methods of producing the metallic particles include the water atomizer, gas atomizer, carbonyl process, or ingot pulverizer, but the production method is not particularly important. For main compositions of the respective metallic particles, if impurities or additives are small, the results are similar. Further, shapes of particles may be spherical, flat, polygonal or any other shapes.

In addition, when a large current flows as DC superimposed, there are losses in core portions (Copper loss) and in coil conductors. Therefore, to decrease DC resistant values last, it is preferable to use the punched coil to provide such a structure without connecting the coil portion and the terminals.

As to the insulation binding agent, from the viewpoint of strength after binding, heat resistance at use, or insulating property, such thermosetting resins as epoxy, phenol, silicon, or polyimide resins or the composite resin thereof are desirable.

For improving particle dispersion of the magnetic particles in the binding agent or with themselves, or for increasing withstand voltage, a dispersant or inorganic materials may be added. As such materials, particles of silane-based coupling material, titanium-based coupling material, titanium alkoxide, water glass, boron nitride, talc, mica, barium sulfate, or tetrafluoro-ethylene can be used.

INDUSTRIAL APPLICABILITY

In the multi-phase magnetic element of the present invention, plural coils are buried in a composite magnetic material, and there exists either a negative coupling of magnetic fluxes or a positive coupling of magnetic fluxes between at least two coils. This structure miniaturizes the multi-phase magnetic element. Further, dispersion of inductance values is reduced within a magnetic substance, and as a result, a ripple current value is decreased. Also, by the coupling of the magnetic fluxes, the multi-phase magnetic element has excellent ripple current properties or DC superimposed properties, which is useful for magnetic elements such as inductors, choke coils or others of electronic equipment.

The invention claimed is:

1. A method of producing a magnetic element for multi-phase operation comprising, mixing soft magnetic alloy particles and an insulation binding agent to prepare a mixture, pressing the mixture to make a formed body such that a coil is buried in the mixture, the coil having:

a first end;

a second end;

a first terminal between the first end and the second end, said first terminal being exposed from the formed body;

a second terminal at the first end; and a third terminal at the second end;

a first part between the first terminal and the first end; and a second part between the first terminal and the second end;

wherein the coil is for generating a coupling between a magnetic flux of the first part and a magnetic flux of the second part; and hardening the insulation binding agent, and wherein the first, second, and third terminals are integral with the coil portion and formed by punching.

2. The method of manufacturing the magnetic element for multi-phase operation according to claim 1, wherein the mixture is granular.

3. The method of producing the magnetic element for multi-phase operation according to claim 1, wherein the insulation binding agent is a thermosetting resin, and the insulation binding agent is hardened by heating.

4. A method of manufacturing a magnetic element for multi-phase operation, comprising:

mixing soft magnetic alloy particles and an insulation binding agent to prepare a mixture, pressing the mixture so as to make a formed body such that a first punched coil and a second punched coil are buried in the mixture, the first punched coil having a first coil portion, a first terminal at a first end thereof, and a second terminal at a second end thereof, the first and second terminals being integral with the first coil portion, the second punched coil having a second coil portion, a third terminal at a first end thereof, and a fourth terminal at a second end thereof, the third and fourth terminals being integral with the second coil portion, and hardening the insulation binding agent, wherein the terminals protrude from the formed body, and wherein the coils are for generating a coupling between a magnetic flux of the first punched coil and a magnetic flux of the second punched coil.

* * * * *